US007604301B1

(12) United States Patent
Lang

(10) Patent No.: US 7,604,301 B1
(45) Date of Patent: Oct. 20, 2009

(54) DUAL AXIS GRINDER BLENDER

(76) Inventor: William J. Lang, 2520 Glidden Rd., Beaverton, MI (US) 48612

( * ) Notice: Subject to any disclaimer, the term of this patent is extended or adjusted under 35 U.S.C. 154(b) by 20 days.

(21) Appl. No.: 11/953,013

(22) Filed: Dec. 8, 2007

Related U.S. Application Data

(60) Provisional application No. 60/873,491, filed on Dec. 7, 2006.

(51) Int. Cl.
*E02F 3/96* (2006.01)

(52) U.S. Cl. ..... 299/75; 299/68; 405/266; 405/258.1

(58) Field of Classification Search ..... 405/263, 405/128.1, 258.1; 299/73–75, 78, 68
See application file for complete search history.

(56) References Cited

U.S. PATENT DOCUMENTS

| | | | | |
|---|---|---|---|---|
| 346,681 | A | 8/1886 | Perry | |
| 3,198,224 | A | 8/1965 | Hiley | |
| 3,389,726 | A | 6/1968 | Good | |
| 3,868,980 | A | 3/1975 | Blum | |
| 3,931,841 | A | 1/1976 | Blum | |
| 4,003,602 | A | 1/1977 | Justice et al. | |
| 4,041,996 | A | 8/1977 | Grover | |
| 4,082,362 | A | 4/1978 | Justice et al. | |
| 4,339,908 | A | 7/1982 | Venick | |
| 4,441,761 | A | 4/1984 | Fields et al. | |
| 4,889,392 | A | 12/1989 | Justice et al. | |
| 5,158,126 | A | 10/1992 | Lang | |
| 5,259,692 | A | 11/1993 | Beller et al. | |
| 5,275,513 | A * | 1/1994 | Geary et al. | 405/266 |
| 5,355,918 | A | 10/1994 | Lang | |
| 5,417,522 | A * | 5/1995 | Kono et al. | 405/266 |
| 5,631,160 | A | 5/1997 | Bruso | |
| 5,830,752 | A | 11/1998 | Bruso | |
| 5,931,605 | A | 8/1999 | Toor et al. | |
| 5,975,644 | A * | 11/1999 | Lang | 299/39.4 |
| 6,152,656 | A | 11/2000 | Curtis et al. | |
| 6,171,024 | B1 | 1/2001 | Curtis et al. | |
| 6,193,444 | B1 | 2/2001 | Jonninen | |
| 6,250,846 | B1 | 6/2001 | Kawabata et al. | |
| 6,270,163 | B1 | 8/2001 | Mullet et al. | |
| 6,626,500 | B1 | 9/2003 | Cribb et al. | |

* cited by examiner

*Primary Examiner*—John Kreck
(74) *Attorney, Agent, or Firm*—Robert L. Farris; Farris Law, P.C.

(57) ABSTRACT

The dual axis grinder includes a support frame with a plate and a mast. The mast is connected to the boom of an excavator and to a hydraulic stick control cylinder. An auger tube is journaled in a bore through the support frame plate for rotation about a vertical axis. Auger flighting may be attached to the auger tube. A central support housing is attached to the bottom of the auger tube. Two cylindrical drums with grinder teeth are journaled on the central support housing for rotation about a horizontal axis that intersects the vertical axis. The auger tube is rotated by a reversible hydraulic motor. The cylindrical drums are driven by one or two reversible hydraulic motors. Hydraulic fluid is provided to drive the two drums cylindrical through a rotary hydraulic manifold. Chemicals to treat environmental contaminates are supplied through a nozzle adjacent to the cylindrical drums.

15 Claims, 6 Drawing Sheets

DUAL AXIS GRINDER BLENDER

CROSS REFERENCE TO RELATED APPLICATIONS

This application claims the benefit of the filing date of U.S. Provisional Application No. 60/873,491 titled DUAL AXIS BLENDER, filed Dec. 7, 2006.

TECHNICAL FIELD

The dual axis grinder blender includes a driven horizontal axis grinder mixer mounted on a lower end of a driven vertical tube, with auger flighting that rotates about a vertical axis to lift soil and contaminates upward.

BACKGROUND OF THE INVENTION

Contamination of the environment has many potential sources. Environmental clean up is required to contain environmental contamination and thereby prevent further damage to the environment. Contamination of soil occurs when contaminants are spilled or dumped on the ground and percolate into the soil. Materials such as hydrocarbons, degreasers, pesticides, dry cleaning fluids, paint solvents, fertilizers and industrial chemicals frequently percolate into the soil. Clean up of such contaminates is generally difficult. Some materials that percolate into the soil can move downward into ground water and form a plume of contaminated water that eventually reaches wells for drinking water. Clean up of such contaminates is difficult, as mentioned above, because the contaminate will follow a path of least resistance. The location of the path of movement can be difficult to determine. The depth of the contamination may also be difficult to determine. The primary problem will most likely be working in hard compact soil that may not have been disturbed by man.

Chemical, mining and dredging operations create sludge. Sludge produced by these operations and other similar operations has often been placed in settling ponds or lagoons. The solids settle to the bottom in these ponds and the water evaporates over time. The solids as well as some of the liquids in these lagoons are often toxic. Toxic liquids as well as toxic solids are environmental contamination hazards. Toxins may leach into ground water. Heavy rains or fast snow melt may wash toxins into streams or lakes. Wind can blow dry toxins into the air and carry them for miles. Earthquakes can destroy dams made to form sludge ponds and let the sludge run out of a containment.

The toxins in the sludge found in settling ponds and lagoons can be contained to prevent environment contamination by removing the sludge and moving it to a safer containment area. Toxins can also be contained by treatment where they are found. Moving toxins to a new location is generally expensive. There may be millions of tons of material to move. Most people are opposed to having a toxin storage facility in their neighborhood. Finding a suitable storage facility located close to sludge or contaminated soil to be contained is difficult. Contaminated material can be spilled during movement from one site to another.

Treating and containing material contaminated by toxins, where the contaminated material is located, is often the best way to prevent further environmental contamination. The material in a settling pond or lagoon is agitated to turn the sediment into a slurry. After the sediment is turned into a slurry, and additive is mixed with the slurry. The additive can be a liquid or a dry material. The additive generally turns the slurry into a solid. The additive may cause a chemical reaction that reduces the quantity of toxic material or that neutralizes the toxic material.

Converting sediment that is four meters or more under the surface of a lagoon into a slurry can be difficult. It is desirable to treat all material that is contaminated with the additive. All untreated sediment is a potential environmental contaminate. Contaminated sediment that is untreated may over time contaminate an aquifer. Contamination in an aquifer can over time spread and may contaminate water wells.

The grinder mixers employed in the past for sediment agitating have had a drum with teeth mounted on the end of an excavator stick and rotated about a horizontal axis by a hydraulic motor. These rotatable drums are moved vertically and horizontally toward and away from the excavator's vertical pivot axis. Drums with teeth that rotate about a horizontal axis work well for turning sediment into a slurry. However horizontal axis rotating drums with grinder teeth do not work well when mixing in hard compact soil conditions to relatively deep treatment depths. The grinder mixers that have been used to agitate sludge do not work well for reduction or stabilization of soil contaminated by percolation of contaminates.

SUMMARY OF THE INVENTION

The dual axis blender grinds up contaminated soils as well as unstable soils, and adds chemical to stabilize the soils. The chemicals added can be liquids or dry materials in the form of powders or granules. If the soil agitated is contaminated, the chemical added may convert the contaminant into a non-hazardous material, destroy the contaminant, or contain the contaminant. Containment may include turning contaminant and soil into solid that will not be carried away by water or wind. Stabilization of unstable soils may also involve turning soil into a solid.

Soil that is contaminated by a percolation of a contaminate into the soil may be hard and dense due to the fact that it has not been moved by man, by natural erosion or by earthquakes for several centuries.

The dual axis grinder blender assembly includes a grinder blender support frame. The support frame includes a support plate with a cylindrical bore and a mast assembly. The mast is welded to the support plate and includes coaxial excavator boom pin apertures that receive a blender pivot shaft and pivotally attach the mast assembly to an excavator boom. The mast also has a pair of coaxial cylinder pin apertures that receive a rod end pivot pin. The rod end pivot pin connects the mast assembly to the rod of a hydraulic stick control cylinder.

An auger tube holder passes through the cylindrical bore through the support plate and is pivotally attached to the support plate for rotation about a vertical axis. A ring gear is attached to the auger tube holder. An auger tube is fixed to the auger tube holder and is concentric with the vertical axis. The auger tube rotates with the auger tube holder. A central support housing is attached to the auger tube and extends downward from the auger tube.

A horizontal grinder blender assembly is secured to the central support housing. The grinder blender assembly may include a shaft journaled in the central support housing. A first cylindrical drum is mounted on one end of the shaft. A second cylindrical drum is mounted on a second end of the shaft. A hydraulic motor mounted inside the auger tube drives both cylindrical drums through a gear train.

Another version of the grinder blender assembly replaces the single hydraulic motor with a first spindle attached to the central support housing. A first motor housing and motor is journaled on the first spindle. The first motor housing is rotatable relative to the first spindle about a horizontal axis of the horizontal grinder blender assembly that intersects the vertical axis. A first cylindrical drum is mounted on the first motor housing. A second hydraulic motor includes a second spindle attached to the central support housing. A second motor housing and hydraulic motor is journaled on the second spindle and is rotatable relative to the second spindle about the horizontal axis. A second cylindrical drum is mounted on the second motor housing. The first and second spindles are secured to the central support housing in fixed positions by bolts. A plurality of first grinder teeth are mounted on the first cylindrical drum. A plurality of second grinder teeth are mounted on the second cylindrical drum.

A rotary hydraulic manifold is mounted on the upper end of the cylindrical auger tube holder. A high pressure fluid discharge port on the rotary hydraulic manifold discharges high pressure fluid to a flow divider. A first high pressure line is connected to the flow divider and supplies hydraulic fluid to the first hydraulic motor. A second high pressure line connected to the flow divider supplies hydraulic fluid to the second hydraulic motor. A fluid return line is connected to the first hydraulic motor and the second hydraulic motor and carries low pressure return hydraulic fluid to a hydraulic fluid return receiving port on the rotary hydraulic manifold.

A manifold inlet port on the rotary hydraulic manifold receives high pressure hydraulic fluid from a pump on the excavator. A hydraulic fluid return port on the rotary hydraulic manifold discharges return fluid to a sump on the excavator.

An auger hydraulic motor mounted on the support frame drives a drive gear that is in mesh with the ring gear to rotate the auger tube holder, the auger tube and the horizontal grinder mixer assembly about the vertical axis. The auger hydraulic motor is reversible. It is desirable to reverse the direction of rotation of the auger tube from time to time in hard compact soil conditions.

Auger flighting on the auger tube improves blending when working in loose material with excess liquid. An auger tube without auger flighting is preferred when working in hard compact soils in dry conditions.

The dual axis grinder blender mixes and blends a chemical with soil when treating contaminated soils. The chemicals employed may be liquid or dry material. Dry material can be powder or granular material. The chemicals are supplied to a swivel connector. The swivel connector is attached to an upper end of an inside additive delivery pipe. The inside additive delivery pipe extends downward through the mast assembly and through a central passage through the rotary hydraulic manifold. A lower end of the inside additive delivery pipe is connected to an outside additive delivery pipe. The outside additive delivery pipe passes through the auger tube and to an additive discharge nozzle. The additive discharge nozzle is mounted on the central support housing between the first cylindrical drum and the second cylindrical drum. The central passage through the rotary hydraulic manifold is co axial with the vertical axis.

BRIEF DESCRIPTION OF THE DRAWINGS

The presently preferred embodiment of the invention is disclosed in the following description and in the accompanying drawings, wherein.

DETAILED DESCRIPTION OF THE PREFERRED EMBODIMENTS

Figure 1:
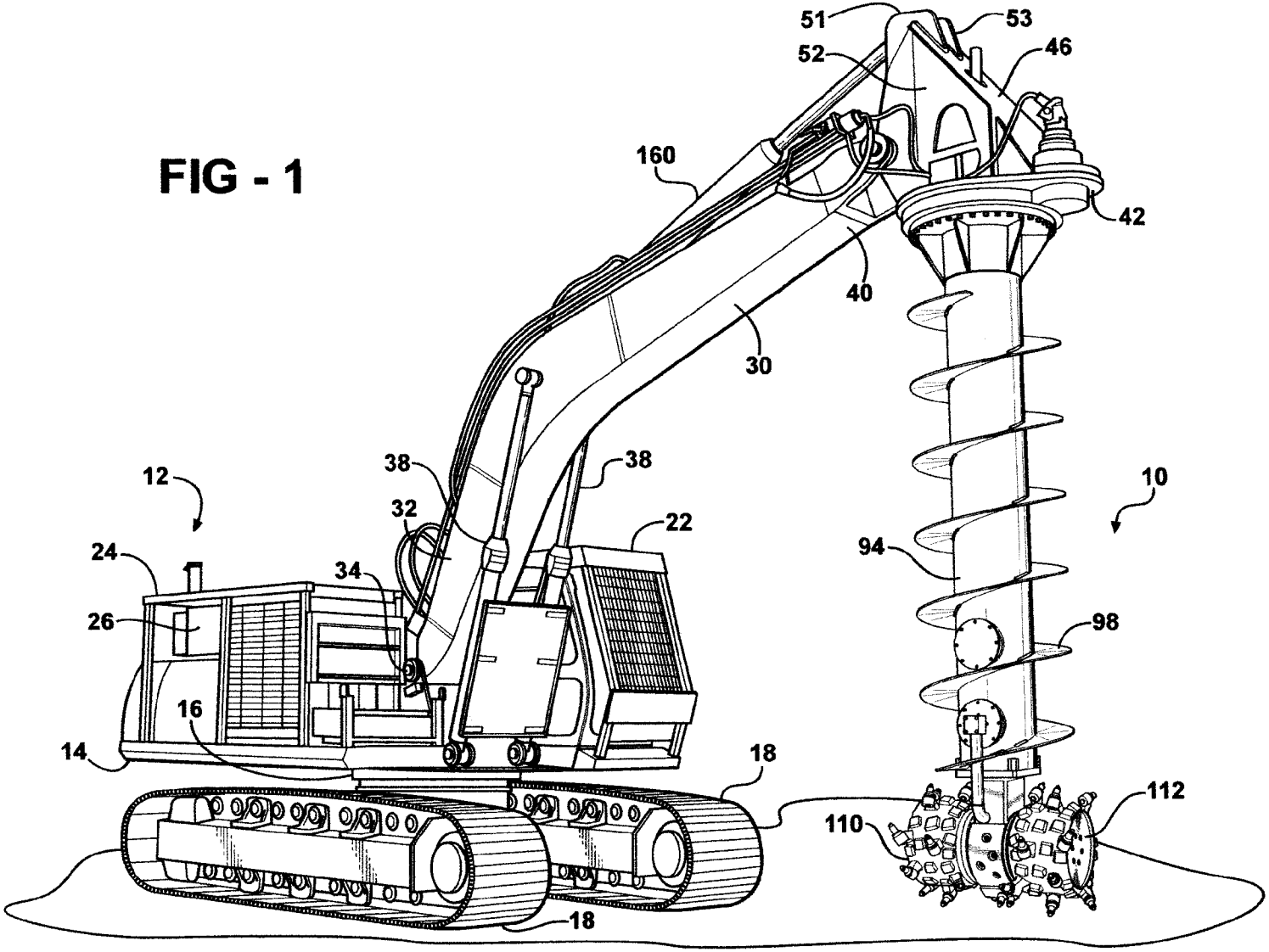
FIG. 1 is a perspective view of the dual axis grinder blender mounted on a hydraulic excavator boom and raised above the surface of contaminated soil.

The dual axis grinder blender assembly 10 is an attachment to a hydraulic excavator 12. The hydraulic excavator includes an excavator frame 14 pivotally attached to a tracked carriage 16 with two space apart parallel track assemblies 18. The excavator frame 14 pivots about a center vertical pivot axis 20.

An operator's enclosure 22 is mounted on a forward portion of the excavator frame 14. An engine enclosure 24 is mounted on the excavator frame 14 to the rear of the operator's enclosure 22. An engine 26 mounted in the engine enclosure 24 drives one or more hydraulic pumps 28. The pumps 28 supply hydraulic fluid under pressure to operate the excavator 12 and the dual axis blender 10.

An excavator boom 30 has a boom excavator end 32 pivotally attached to the frame 14, by a boom pivot assembly 34, for pivotal movement about a transverse horizontal boom axis 36. One or more hydraulic cylinders 38 pivot the excavator boom 30 about the boom axis 36 to raise and lower the boom stick end 40 of the excavator boom 30.

The dual axis grinder blender assembly 10 includes a support plate 42 with a cylindrical bore 44. A mast assembly 46 is fixed to an upper surface 48 of the support plate 42. The mast assembly includes a left wall 50 and a right wall 52. The left and right walls 50 and 52 are spaced apart and generally parallel to each other. A front plate 54 extends from the left wall 50 to the right wall 52. Edges of the front plate 54 are welded to the left wall 50, the right wall 52 and the upper surface 48 of the support plate 42. A rear plate 56 extends from the left wall 50 to the right wall 52. Edges of the rear plate 56 are welded to the left wall 50, the right wall 52, the upper surface 48 of the support plate 42, and an upper edge of the front plate 54. Cylinder pin apertures 58 are provided through the left wall 53 and the right wall 51 fixed to the mast assembly 46. Boom pin apertures 60 are provided through the left wall 50 and the right wall 52.

An inside bearing race 62 is attached to a lower surface 64 of the support plate 42 by bolts 67. An outside bearing race 66 is connected to the inside bearing race 62 by a plurality of bearing balls 68 that are inserted into grooves in the bearing races. The balls 68 hold the races 62 and 66 spaced apart and concentric with each other.

A cylindrical auger tube holder 70 is telescopically received in the cylindrical bore 44 through the support plate 42. A radially extending flange 72, integral with a tube holder 70, carries a spacer ring 74. The spacer ring 74 contacts the outside bearing race 66 and limits movement of the tube holder 70 through the cylindrical bore 44. Bolts 76 pass through the flange 72 and the spacer ring 74 and screw into threaded bores in the outside bearing race 66. The bolts 76 prevent movement between the flange 72 and the bearing race 66. Gear teeth 78 are integral with and extend radially outward from the outside bearing race 66 and form a ring gear.

A hydraulic motor 80 is clamped to the upper surface 48 of a wing portion 82 of the support plate 42 by bolts 84. The hydraulic motor 80 may rotate in one direction only or it may be selectively reversible and rotatable in two different directions. A gear 86 driven by the hydraulic motor 80 meshes with the gear teeth 78 and rotates the auger tube holder 70 when driven by the motor 80. Gussets 88 reinforce the radially extending flange 72. A gear case 90 encloses gear 86 and the gear teeth 78. A seal 92 seals the space between the cylindrical bore 44 and the cylindrical auger tube holder 70.

An auger tube 94 is telescopically received in the bore 96 in the lower end of the auger tube holder 70 and fixed relative to the holder. Auger flighting 98 is fixed to the outer surface of the auger tube 94. The hydraulic motor 80 drives the tube holder 70 to rotate the auger tube 94 about a vertical auger axis 100. A plate 102 with a central aperture 104 is fixed to the lower end of the auger tube 94.

Figure 2:
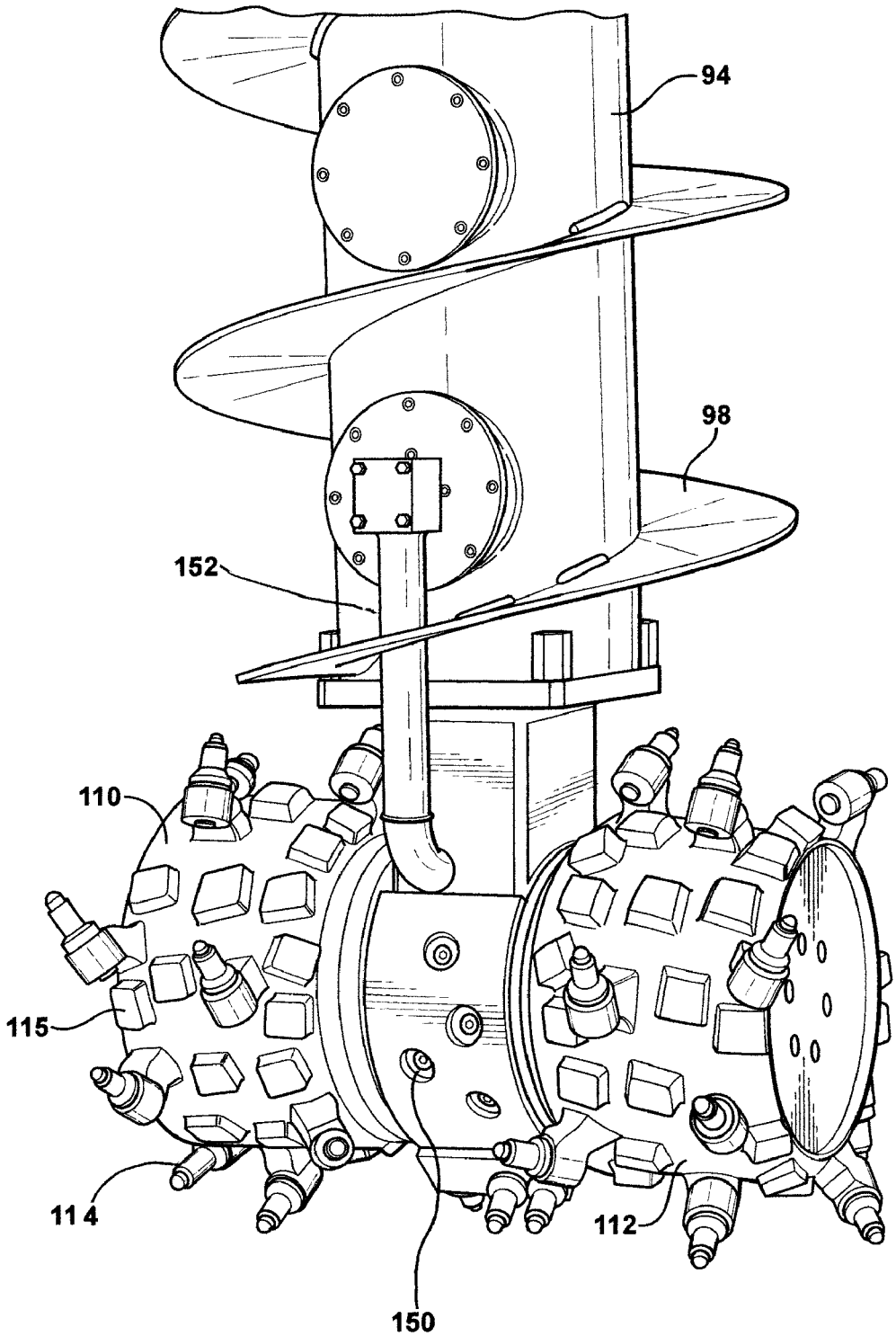
FIG. 2 is an enlarged perspective view of a lower portion of the dual axis grinder blender with a single hydraulic motor driving two cylindrical drums about a grinder mixer horizontal axis and with parts broken away.

A horizontal grinder mixer assembly 106 is attached to the plate 102. The horizontal grinder mixer assembly 106 includes a central drive housing 108. Rotatable cylindrical drums 110 and 112 are mounted on the ends of a shaft that passes through the housing 108. The outer surface of both cylindrical drums 110 and 112 include a plurality of grinder teeth 114. The teeth 114 are replaceable and are held by teeth holders 116 that are welded to the outer surface of the drums 110 and 112. The teeth 114 are preferably carbide or other hard material that provides adequate resistance to wear. The square blocks 115, shown in FIG. 2, are optional members that protect the outer surfaces of the drums 110 and 112 when used in abrasive materials. A hydraulic motor 118 drives the drums 110 and 112 through a speed reduction planetary gear train. The cylindrical drums 110 and 112 both rotate together about a grinder mixer horizontal axis 120 that intersects the vertical auger axis 100. A flange 122 on the central drive housing 108 is clamped to the plate 102 and holds the hydraulic motor 118 inside the auger tube 94.

A rotary hydraulic manifold 130 includes an inner spindle 134 that is clamped to an auger top end plate 132 by bolts 136. The inner spindle has a high pressure hydraulic fluid supply port 205*a* and a hydraulic fluid return port 220*a*. The top end plate 132 is attached to the upper end of the cylindrical auger tube holder 70 by bolts 128. An outer housing portion 138 of the rotary hydraulic manifold 130 is anchored relative to the support plate 42. A central passage 140, through the manifold 130 and the auger top end plate 132, is coaxial with the vertical auger axis 100. Hydraulic fluid is supplied from a hydraulic pump 28 through a flow control valve to the outer housing portion 138 of the rotary hydraulic manifold 130 through a manifold inlet port 141. Hydraulic fluid is returned to a sump through a manifold return port 143. The hydraulic motor 118 receives hydraulic fluid under pressure from the inner spindle 134 through hydraulic fluid supply port 205*a* and hydraulic line 205. Return hydraulic fluid from the hydraulic motor 118 is through a discharge line 220 to return port 220*a* on the inner spindle 134 of the rotary hydraulic manifold 130.

The hydraulic motor 118, as described above, is a high speed low torque motor. Low speed high torque motors described below could replace the hydraulic motor 118 and eliminate a portion of the planetary gear train.

The hydraulic motor 80 receives hydraulic fluid under pressure from a second flow control valve. The second flow control valve receives hydraulic fluid under pressure from a hydraulic pump 28 in the engine enclosure 24. The high speed low torque motor 80 can also be replaced by a high torque low speed motor.

An additive delivery nozzle 150 is mounted on the central drive housing 108 between the rotatable cylindrical drums 110 and 112. The nozzle 150 is connected to an outside delivery pipe 152 that extends upward a short distance and then passes through the wall of the auger tube 94. An inside delivery pipe 154 is connected to the outside delivery pipe 152 and extends upward through the central passage 140 through the manifold 130 and through the front plate 54 of the mast assembly 46. The inside delivery pipe 154 is free to rotate relative to the mast assembly 46. A swivel connector 156 is attached to an inlet end of the inside delivery pipe 154. An additive delivery pipe is attached to the non rotatable end of the swivel connector 156.

A grinder blender pivot shaft 144 passes through the boom pin apertures 60 through the mast assembly 46 and through the boom free end bore 146. A hydraulic stick control cylinder 160 has a head end pivotally connected to the boom 30 by a head end pivot pin 162. A rod 168 of the stick control cylinder 160 is pivotally connected to the mast assembly 46 by a rod end pivot pin 164 that passes through cylinder pin apertures 58 and the cylinder rod 168.

During operation of the dual axis blender 10, the hydraulic motor 118 rotates the cylindrical drums 110 and 112 of the horizontal grinder mixer assembly 106 about the grinder mixer horizontal axis 120. At the same time, the hydraulic motor 80 rotates the auger tube 94 and the attached horizontal grinder mixer assembly about the vertical axis 100. The auger flighting 98 lifts soil and contaminates mixed with the soil upward. An additive is added to the ground soil and contaminates through the nozzle 150 and mixed with the mixture of soil and contaminates. The additive added to the mixture can have different purposes. One additive may for example turn the contaminated soil into a solid. Another additive may cause a reaction that neutralizes contaminates in the soil. The ultimate purpose of the additive may be to contain material that poses an environmental threat. The purpose may also be to stabilize soil that is unstable. A third purpose may be to lift contaminated soil to the surface for transport to an approved disposal facility.

Figure 5:
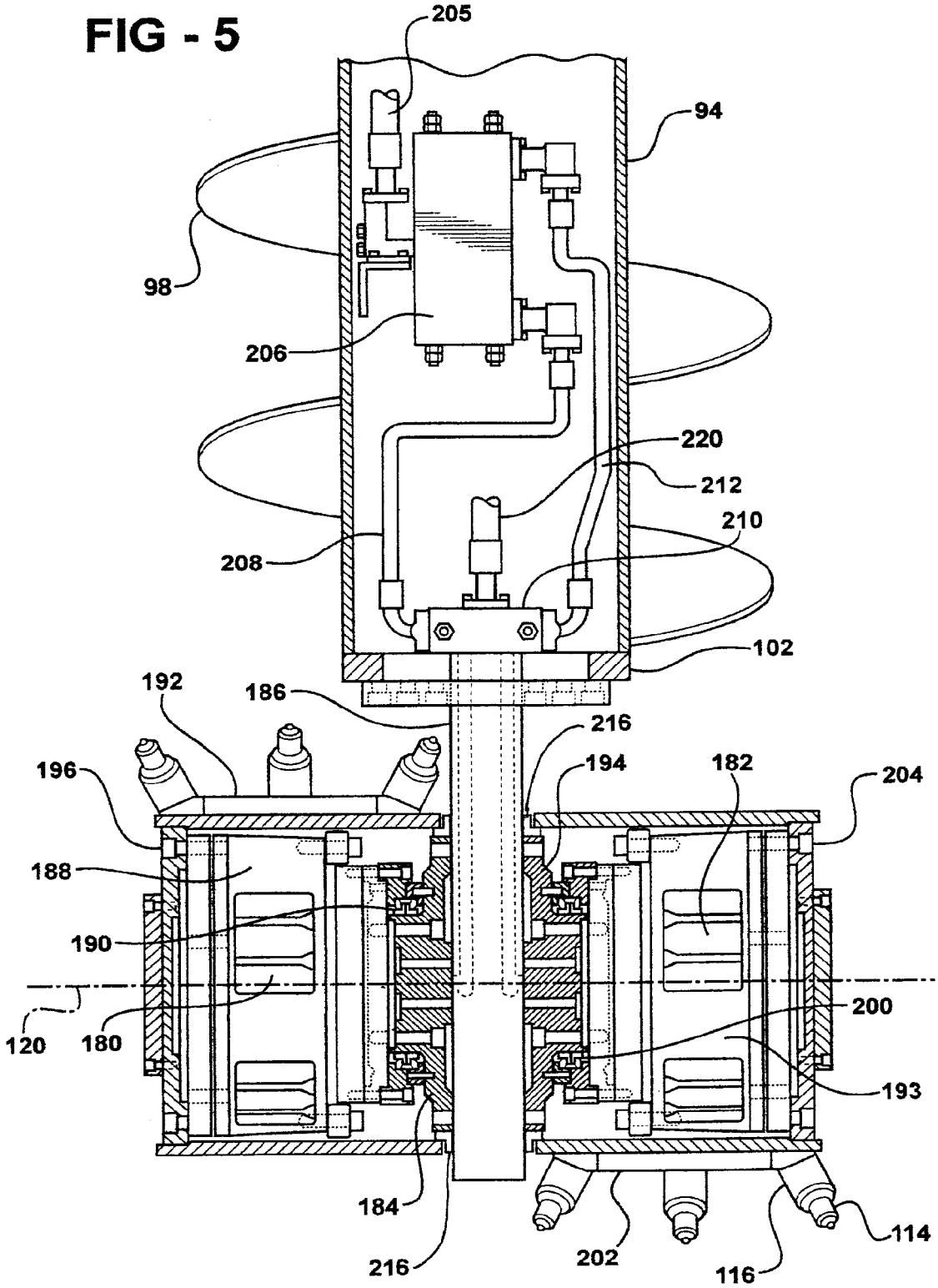
FIG. 5 is an enlarge elevational view of the lower part of the dual axis grinder blender with two low speed high torque hydraulic motors driving the cylindrical drums about a grinder mixer horizontal axis and with parts broken away.
Figure 6:
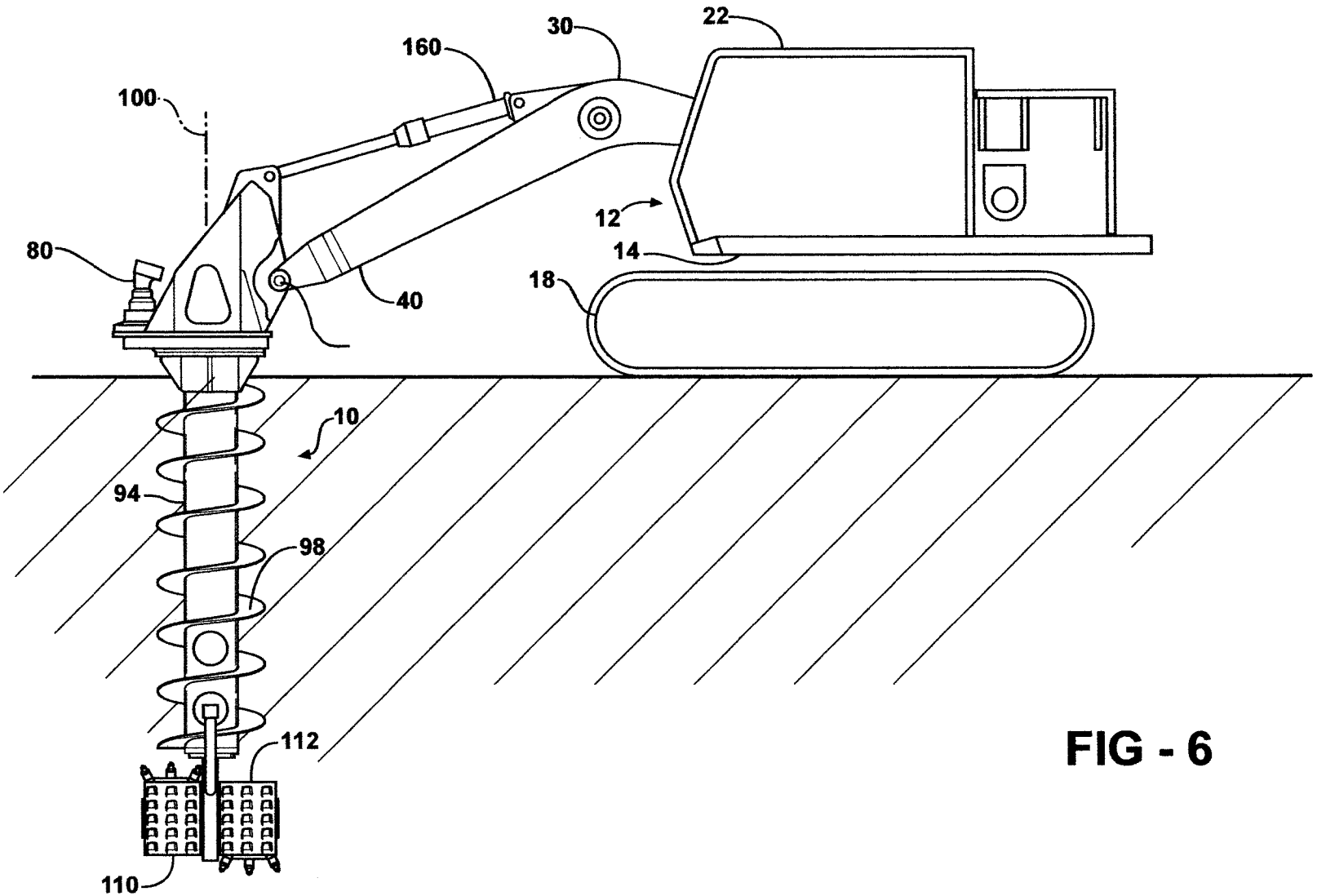
FIG. 6 is a side elevational view, of the dual axis blender lowered into sediment, and mounted on a hydraulic excavator with parts broken away.

The hydraulic motor 118 and planetary gear train can also be replaced by two low speed high torque hydraulic motors 180 and 182 as shown in FIG. 5. Two hydraulic motors improve operation when working in soils with rocks or hard compact material. The high torque motor 180 includes a spindle 184 that is bolted to a central support housing 186. A motor housing 188 is journaled on the spindle 184 bearings in the hydraulic motor. A cylindrical drum 192 is secured to the motor housing 188 by bolts 196. A seal 190 in the motor 180 and a seal 216 between the drum 192 and the central support housing 186 protect the motor and reduce fluid leaks.

The low speed high torque motor 182 includes a spindle 194 that is bolted to the central support housing 186. A motor housing 198 is journaled on the spindle 194 by bearings in the hydraulic motor. A cylindrical drum 202 is secured to the motor housing 198 by bolts 204. A seal 200 in the motor 182 and a seal 218 between the drum 202 and the spindle 194 protect the motor and reduce fluid leaks.

The hydraulic fluid supply line 205 receives hydraulic fluid under pressure, from the rotary hydraulic manifold 130, and discharges the hydraulic fluid to a flow divider 206. The flow divider 206 supplies hydraulic fluid to the low speed high torque motor 180 through a high pressure line 208, a manifold 210, a passage through the central support housing 186 and a passage through the spindle 184. The flow divider 206 also supplies hydraulic fluid to the low speed high torque motor 182 through a high pressure line 212, the manifold 210, a passage through the central support housing 186 and a passage through the spindle 194. Return hydraulic fluid from the motor 180 and the motored 182 flows from the spinals 184 and 194, the central support housing 186 and through a hydraulic fluid return line 220, through the rotary hydraulic manifold 130 and to the hydraulic fluid pump 28.

An alternate hydraulic system for driving the hydraulic motors 180 and 182 includes two separate hydraulic pumps driven by the engine 26. One pump supplies hydraulic fluid under pressure, through a first fluid passage through the rotary hydraulic manifold 130 and the manifold 210, directly to the first horizontal axis hydraulic motor 180. The other hydraulic pump supplies hydraulic fluid under pressure, through a second fluid passage through the rotary hydraulic manifold 130 and the manifold 210 directly to the second horizontal axis hydraulic motor 182. With this alternate hydraulic system, the flow divider 206 is eliminated. Another hydraulic fluid system for driving the hydraulic motors 180 and 182 has a single pump and a flow divider outside the dual axis blender 10.

Figure 3:
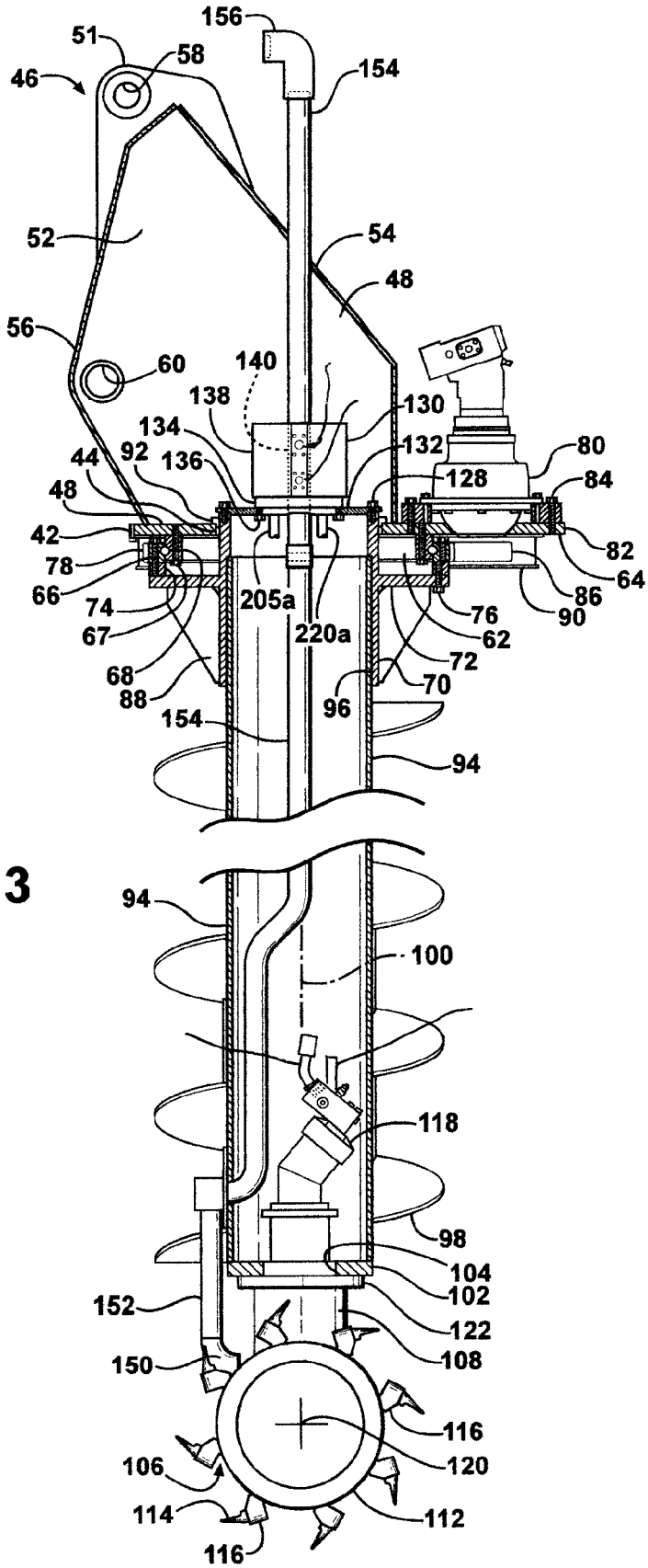
FIG. 3 is a vertical fore and aft sectional view of the dual axis grinder blender.
Figure 4:
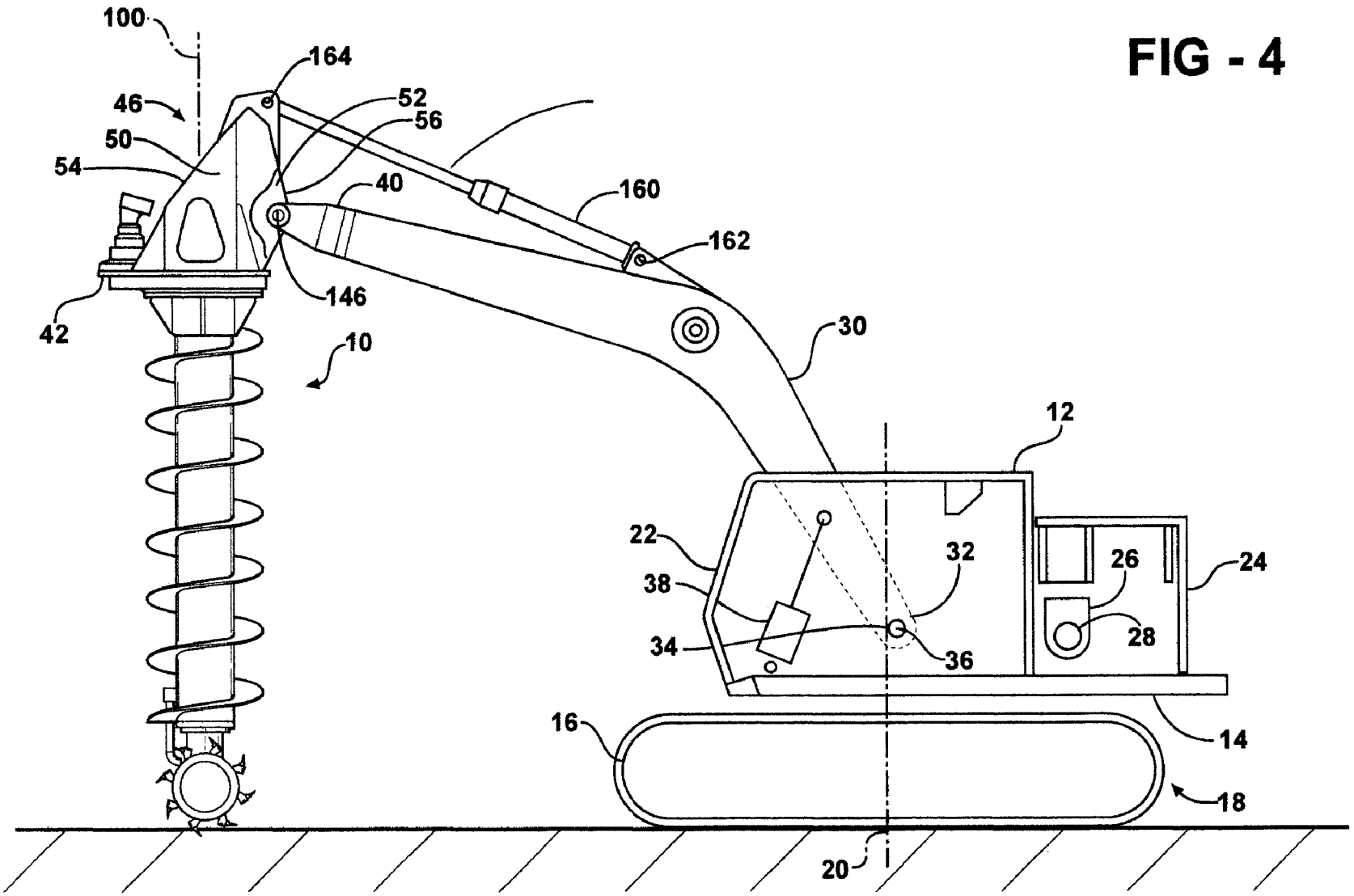
FIG. 4 is a side elevational view with parts broken of the dual axis blender mounted on a hydraulic excavator boom and raised above the surface of contaminated soil.

The system with a cylindrical drum 192 driven by a high torque hydraulic motor 180 and a cylindrical drum 202 driven by a high torque hydraulic motor 182 supplies substantially more power to the two horizontal axis grinding drums than the single hydraulic motor 118 shown in FIG. 3. The additional power to the horizontal axis cylindrical drum 192 and the horizontal axis cylindrical drum 202 improves performance in remedial treatment of contaminants that leach into soils that have not been disturbed by man. When working in hard clay soils or rocks, it may be desirable to reverse the direction of rotation of the hydraulic motor 80 and the auger tube 94 periodically. In such conditions the auger flighting 98 is removed from the auger tube 94 to keep the auger flighting from forcing the horizontal grinder mixer assembly 106 upward.

Both cylindrical drums 192 and 202 are driven so that the grinder teeth 114 move upwardly and toward undisturbed material. As a result, the cylindrical drum 192 is driven in one direction about the grinder mixer horizontal axis 120, by the hydraulic motor 180 and the cylindrical drum 202 is driven in the opposite direction about the grinder mixer horizontal axis 120 by the hydraulic motor 182.

The disclosed embodiments are representative of a presently preferred form of the invention, but are intended to be illustrative rather than definitive thereof. The invention is defined in the claims

The invention claimed is:

1. A dual axis grinder blender assembly comprising a grinder blender support frame including mast with a pair of coaxial excavator boom pin apertures, a blender pivot shaft mounted in the pair of coaxial excavator boom pin apertures, a pair of coaxial cylinder pin apertures, and a rod end pivot pin mounted in the pair of coaxial cylinder pin apertures;

an auger tube journaled on the grinder blender support frame for rotation about a vertical axis;

a central support housing mounted on the auger tube and extending downward from the auger tube;

a first drum journaled on the central support housing for rotation about a horizontal grinder axis that intersects the vertical axis;

a second drum journaled on the central support housing for rotation about the horizontal grinder axis;

a plurality of first grinder teeth mounted on the first drum and a plurality of second grinder teeth mounted on the second drum;

at least one hydraulic motor supported by the grinder blender support frame and engaging the support frame and the auger tube to rotate the auger tube about the vertical axis; and at least one hydraulic motor rotating the first drum and the second drum about the horizontal grinder axis.

2. A dual axis grinder blender assembly, as set forth in claim 1, including auger flighting mounted on the auger tube.

3. A dual axis grinder blender assembly, as set forth in claim 1, wherein the at least one hydraulic motor supported by the grinder blender support frame is mounted directly on the grinder blender support frame, and includes an output gear that is in mesh with a ring gear attached to the auger tube.

4. A dual axis grinder blender assembly, as set forth in claim 1, wherein the at least one hydraulic motor supported by the grinder blender support frame and engaging the support frame and the auger tube is reversible.

5. A dual axis grinder blender assembly, as set forth in claim 1 including an additive delivery nozzle positioned adjacent to the central support housing, an outside additive delivery pipe connected to the additive delivery nozzle and extending into the auger tube, an inside additive delivery pipe mounted inside the auger tube, connected to the outside additive delivery pipe and extending upwardly through the auger tube, a swivel connector connected to an upper end of the inside additive delivery pipe, and wherein the swivel connector receives additives and passes the additives through the inside additive delivery pipe, the outside additive delivery pipe and the additive delivery nozzle.

6. A dual axis grinder blender assembly comprising a grinder blender support frame with a cylindrical bore;

a mast assembly attached to the grinder blender support frame and including a pair of coaxial excavator boom pin apertures for a blender pivot shaft and a pair of coaxial cylinder pin apertures for a rod end pivot pin;

an auger tube holder passing through the cylindrical bore and journaled on the grinderblender support frame for rotation about a vertical axis;

an auger tube fixed to the auger tube holder and concentric with the vertical axis;

a central support housing fixed to the auger tube and extending downward from the auger tube;

a horizontal grinder mixer assembly including a first rotatable cylindrical drum journaled on the central support housing for rotation about a grinder axis that is transverse to the vertical axis, a second rotatable cylindrical drum journaled on the central support housing for rotation about the grinder axis, a plurality of first grinder teeth attached to the first rotatable cylindrical drum, and a plurality of second grinder teeth attached to the second rotatable cylindrical drum;

a grinder hydraulic motor mounted inside the auger tube and connected to the first rotatable cylindrical drum and to the second rotatable cylindrical drum by a gear train to rotate the first and second rotatable cylindrical drums about the grinder axis;

an auger hydraulic motor mounted on the grinder blender support frame support and having a drive gear that meshes with a ring gear mounted on the auger tube holder to rotate the auger tube about the vertical axis; and wherein the grinder axis intersects the vertical axis.

7. A dual axis grinder blender assembly, as set forth in claim 6, including auger flighting mounted on the auger tube.

8. A dual axis grinder blender, as set forth in claim 6, wherein the auger hydraulic motor is reversible.

9. A dual axis grinder blender, as set forth in claim 6, including an additive delivery nozzle positioned between the first rotatable cylindrical drum and the second rotatable cylindrical drum and adjacent to the central support housing, an outside delivery pipe connected to the additive delivery nozzle and extending into the auger tube, an inside delivery pipe connected to the outside delivery pipe and extending upwardly through the auger tube holder and a swivel connector connected to an upper end of the inside delivery pipe, and wherein the swivel connector receives chemical additives that pass through the inside delivery pipe, the outside delivery pipe, and the additive delivery nozzle.

10. A dual axis grinder blender assembly, as set forth in claim 6, including a rotary hydraulic manifold with a manifold portion that rotates with the auger tube holder and has hydraulic fluid supply port and a hydraulic fluid return port, a non rotating manifold portion with manifold inlet port that receives high pressure hydraulic fluid and a manifold return port that discharges return fluid, and a manifold central passage for a chemical delivery pipe;

a hydraulic fluid supply line connected to the hydraulic fluid supply port on the rotary hydraulic manifold and to the grinder hydraulic motor mounted inside the auger tube; and a hydraulic fluid return line connected to grinder hydraulic motor mounted inside the auger tube and to the hydraulic fluid return port on the rotary hydraulic manifold.

11. A dual axis grinder blender comprising a support frame with a cylindrical bore;

a mast assembly attached to the support frame, extending upward from the support frame, and including a pair of coaxial excavator boom pin apertures that receive a blender pivot shaft, and a pair of coaxial cylinder pin apertures that receive a rod end pivot pin;

an auger tube holder passing through the cylindrical bore, journaled on the support frame for rotation about a vertical axis and including a ring gear fixed to the auger tube holder;

an auger tube fixed to the auger tube holder, concentric with the vertical axis and rotatable with the auger tube holder;

a central support housing attached to the auger tube and extending downward from the auger tube;

a horizontal grinder blender assembly including a first hydraulic motor with a first spindle attached to the central support housing, a first motor housing and hydraulic motor journaled on the first spindle and rotatable relative to the first spindle about a horizontal axis of the horizontal grinder blender assembly that intersects the vertical axis, and a first cylindrical drum mounted on the first motor housing;

a second hydraulic motor with a second spindle attached to the central support housing, a second motor housing and hydraulic motor journaled on the second spindle and rotatable relative to the second spindle about the horizontal axis, and a second cylindrical drum mounted on the second motor housing;

a plurality of first grinder teeth mounted on the first cylindrical drum and a plurality of second grinder teeth mounted on the second cylindrical drum;

a rotary hydraulic manifold mounted on and upper end of the cylindrical auger tube holder, a high pressure fluid discharge port on the rotary hydraulic manifold that discharges high pressure fluid to a flow divider, a first high pressure line connected to the flow divider that supplies hydraulic fluid to the first hydraulic motor, a second high pressure line connected to the flow divider that supplies hydraulic fluid to the second hydraulic motor, a fluid return line connected to the first hydraulic motor and the second hydraulic motor that carries low pressure return hydraulic fluid to a hydraulic fluid return receiving port on the rotary hydraulic manifold;

a manifold inlet port on the rotary hydraulic manifold that receives high pressure hydraulic fluid and a hydraulic fluid return port on the rotary hydraulic manifold that discharges return fluid to a sump; and an auger hydraulic motor mounted on the support frame that drives a drive gear in mesh with the ring gear to rotate the auger tube holder, the auger tube and the horizontal grinder blender assembly about the vertical axis.

12. A dual axis grinder blender, as set forth in claim 11, wherein the auger hydraulic motor is reversible.

13. A dual axis grinder blender, as set forth in claim 11, including auger flighting mounted on the auger tube.

14. A dual axis grinder blender as set forth in claim 11, including a swivel connector that receives chemical additives, an inside additive delivery pipe connected to the swivel connector, extending downward through a central passage through the rotary hydraulic manifold to an outside additive delivery pipe and an additive discharge nozzle mounted on the central support housing that discharges a chemical additive received through the inside additive delivery pipe and the outside additive delivery pipe.

15. A dual axis grinder blender, as set forth in claim 14, wherein the central passage through the rotary hydraulic manifold is coaxial with the vertical axis.

* * * * *